US005564815A

United States Patent [19]

Littman et al.

[11] Patent Number: 5,564,815

[45] Date of Patent: Oct. 15, 1996

[54] ADJUSTABLE LIGHT FIXTURE

[75] Inventors: Eugene Littman; Cecil Mann, both of Newburgh; Steven Proner, Hurley, all of N.Y.

[73] Assignee: Lightron of Cornwall Incorporated, New Windsor, N.Y.

[21] Appl. No.: 267,611

[22] Filed: Jun. 29, 1994

[51] Int. Cl.[6] ..... F21V 21/04

[52] U.S. Cl. ..... 362/147; 362/269; 362/275; 362/287; 362/220; 362/365; 362/274

[58] Field of Search ..... 362/220, 148, 362/150, 364, 365, 217, 285, 287, 269, 270, 274, 372, 250, 249, 232, 233, 288, 147

[56] References Cited

U.S. PATENT DOCUMENTS

| | | | |
|---|---|---|---|
| 2,740,885 | 4/1956 | Kruger | 240/51.11 |
| 3,287,552 | 11/1966 | Drandell | 362/233 |
| 3,643,086 | 2/1972 | Shaw | 362/364 |
| 3,702,928 | 11/1972 | Alger | 362/804 |
| 4,161,019 | 7/1979 | Mulvey | 362/147 |
| 4,171,535 | 10/1979 | Westermann | 362/148 X |
| 4,204,274 | 5/1980 | Liideritz | 362/287 |
| 4,287,554 | 9/1981 | Wolff | 362/218 |
| 4,419,717 | 12/1983 | Price et al. | 362/148 |
| 4,454,569 | 6/1984 | Maguire | 362/287 |
| 4,511,954 | 4/1985 | Marcus et al. | 362/287 |
| 4,716,504 | 12/1987 | Pahl | 362/365 X |
| 4,729,080 | 3/1988 | Fremont et al. | 362/365 X |
| 4,739,454 | 4/1988 | Federgreen | 362/217 X |
| 4,799,178 | 10/1988 | Spitz | 362/220 X |
| 4,855,886 | 8/1989 | Eijkelenboom et al. | 362/217 |
| 4,935,854 | 6/1990 | Kernodle | 362/220 |
| 4,947,297 | 8/1990 | Druffel et al. | 362/147 |
| 4,967,324 | 10/1990 | Barclay | 362/147 |
| 5,145,249 | 9/1992 | Bruckner | 362/365 |
| 5,268,824 | 12/1993 | Czipri | 362/287 |
| 5,289,358 | 2/1994 | Halemeier | 362/365 |

OTHER PUBLICATIONS

Engineered Lighting Products, El Monte, California; AK Series Recessed Wall Washer, Yoke Mounted Wall Washer, Recessed Low Level Flood Light; 1992 Elliptipar advertisement; Architectural Record Lighting, p. 7, May 1995.

Indy Lighting (Juno Lighting), Fishers, Ind.; Compact Fluorescent Wallwash/Flood Track Fixture 701T, Compact Fluorescent Recessed Wallwash/Accent 714R SPI, Lighting, Inc., EDR–ECR–SR–1733 Fixture.

Adjustable Par 38 Elbow, Series PDA–6, Lightron of Cornwall, Inc. catalog sheet (Sep. 1992).

Elliptipar, Inc. Advertisement, Lighting Design & Application, vol. 23, No. 9, p. 35 (Sep. 1993).

*Primary Examiner*—Denise L. Gromada
*Assistant Examiner*—Thomas M. Sember
*Attorney, Agent, or Firm*—Fish & Richardson P.C.

[57] ABSTRACT

A lamp assembly for supporting at least one elongated lamp is pivotally attached to a mounting structure so that the lamp assembly is rotatable with respect to the mounting structure about an axis generally aligned with a longitudinal axis of the lamp. An otherwise substantially enclosed housing has an opening sized to admit a lamp assembly that pivotally attaches to the housing such that it is rotatable through the opening, and a friction assembly attached to the lamp assembly provides a slidable frictional interface with the housing.

25 Claims, 6 Drawing Sheets

ADJUSTABLE LIGHT FIXTURE

BACKGROUND OF THE INVENTION

This invention relates to electrical light fixtures, and in particular to light fixtures for supporting elongated lamps such as florescent lamps.

Light fixtures for supporting elongated lamps such as florescent lamps typically include a housing that can be either mounted in or hung from a ceiling. Generally, the lamp is supported with its longitudinal axis oriented horizontally, and a reflector mounted above the lamp projects light from the lamp vertically downward to illuminate an area directly below the fixture.

SUMMARY OF THE INVENTION

In a general aspect of the invention, a lamp assembly for supporting at least one elongated lamp is pivotally attached to a mounting structure so that the lamp assembly is rotatable with respect to the mounting structure about an axis generally aligned with a longitudinal axis of the lamp.

Among other advantages, the lamp assembly can be rotated continuously through a range of angles to change the direction of the illumination provided by the elongated lamp. The elongated lamp may have characteristics—such as color, intensity, and energy efficiency—well-suited to a particular lighting application.

In a particularly useful embodiment, a friction assembly attached to the lamp assembly is disposed in a slot in a curved bracket attached to the mounting structure. The friction assembly provides a slidable frictional interface with the bracket. In particular, the friction assembly includes first and second bearings (e.g., nylon washers) disposed on opposite sides of the bracket, and a spring that urges the first bearing toward the second. The spring force may be adjusted to vary the force on the first bearing (and thus also the frictional force between the bearings and the bracket). A ballast for the elongated lamp (e.g., a florescent lamp) attaches to the mounting structure so as not to rotate with the lamp assembly. Mounts (e.g., t-bar clips or adjustable flange units) in the mounting structure enable the light fixture to be attached to a ceiling, and the lamp assembly is pivotally attached to the mounting structure by a hinge extending substantially along the length of the lamp assembly.

In another aspect of the invention, an otherwise substantially enclosed housing has an opening through which a lamp assembly pivotally attached to the housing may rotate, and a friction assembly attached to the lamp assembly provides a slidable frictional interface with the housing.

Among other advantages of this aspect of the invention, the housing reduces the amount of foreign matter that enters the interior of the light fixture. Thus, the friction assembly and the pivot mechanism are less likely to become fouled with dust, dirt, or other extraneous matter.

In a particularly useful embodiment of this aspect of the invention, the housing includes an adjustment hole disposed such that the friction assembly aligns with the hole as the lamp assembly rotates through the opening.

Other features and advantages of the invention will become apparent from the following detailed description, and from the claims.

DESCRIPTION OF THE PREFERRED EMBODIMENTS

Figure 1:
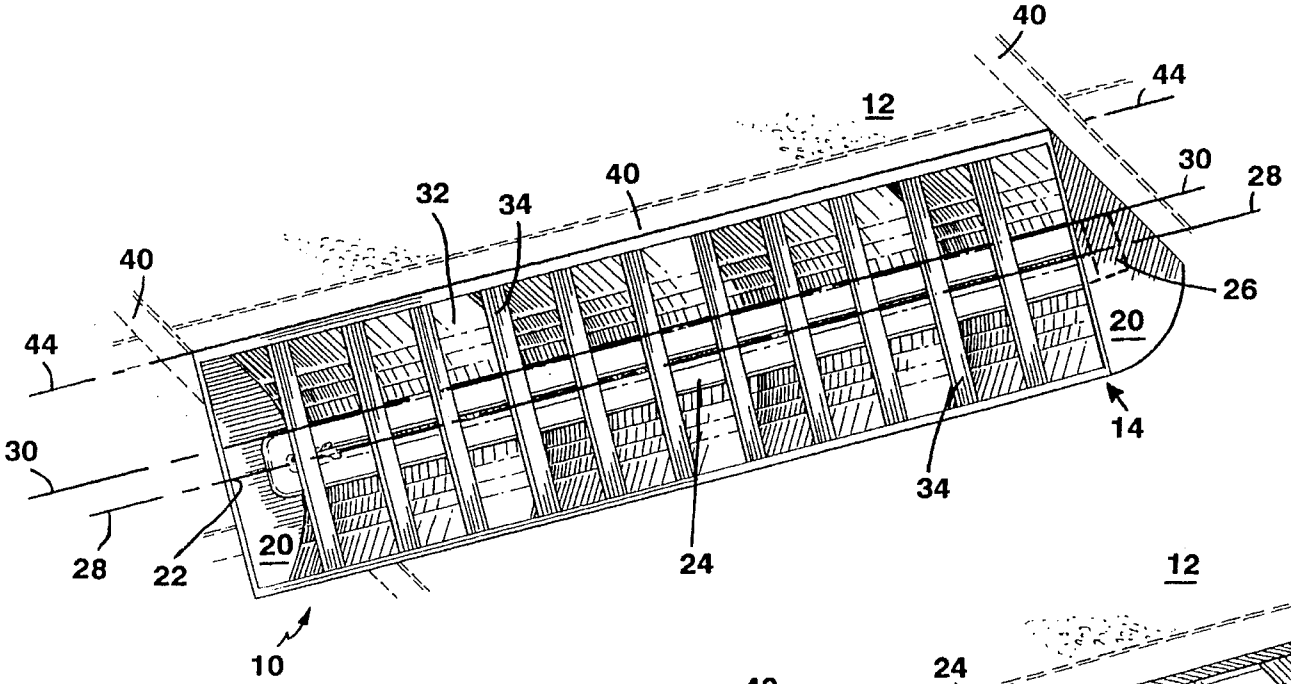
FIG. 1 is a perspective view of a light fixture installed in a suspended ceiling with a lamp assembly fully rotated.
Figure 3:
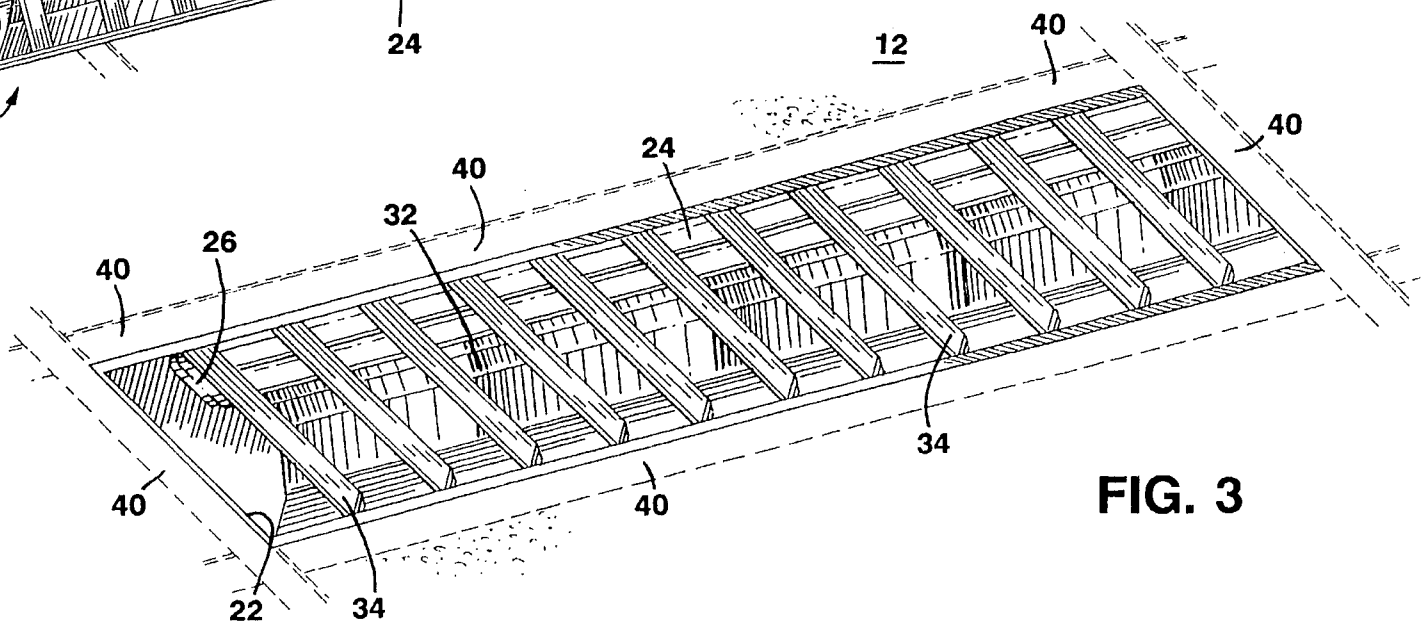
FIG. 3 is a perspective view of the light fixture of FIG. 1 with the lamp assembly fully recessed into the light fixture.
Figure 2:
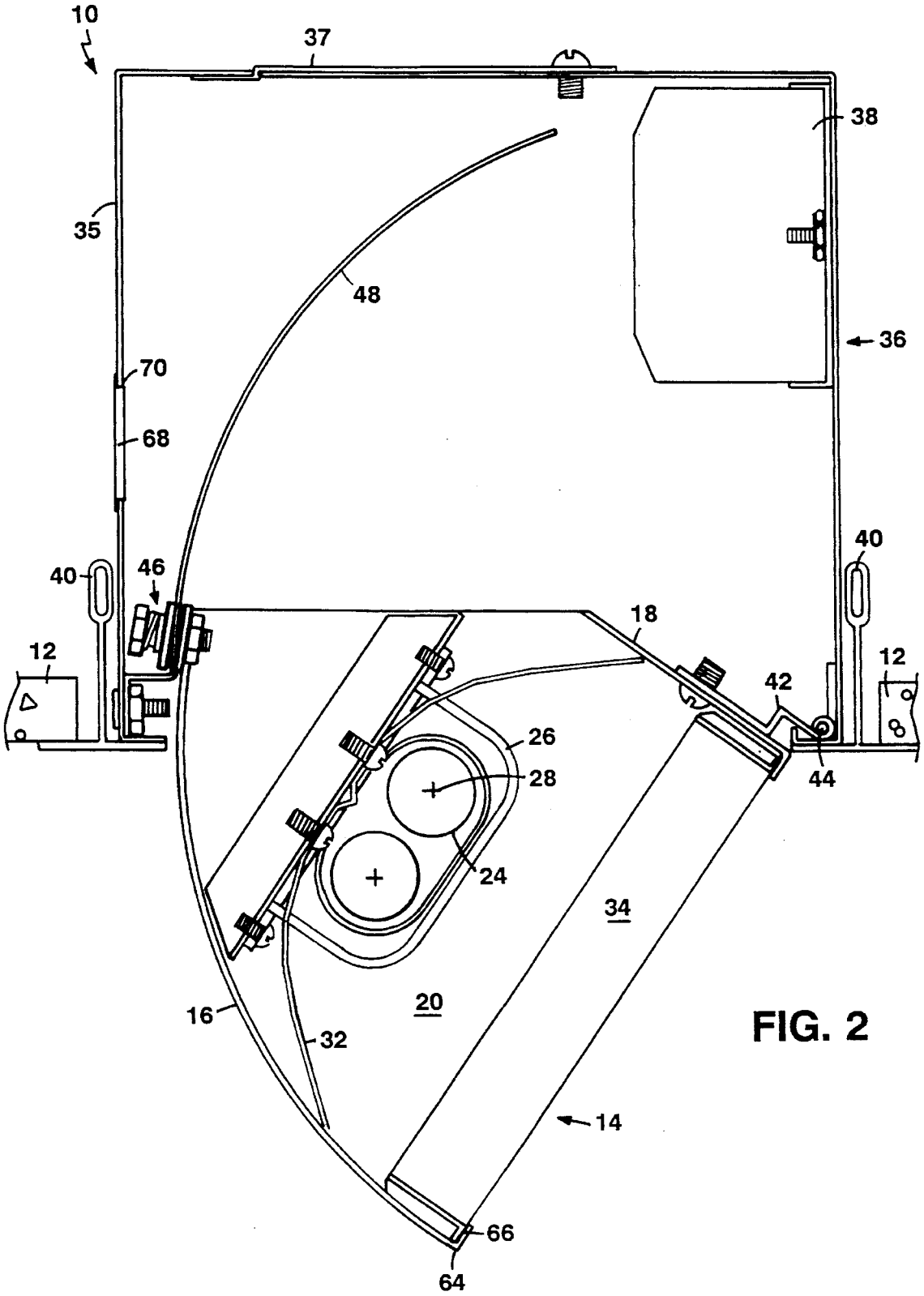
FIG. 2 is a cross-sectional view of the light fixture in the rotational orientation shown in FIG. 1.
Figure 4:
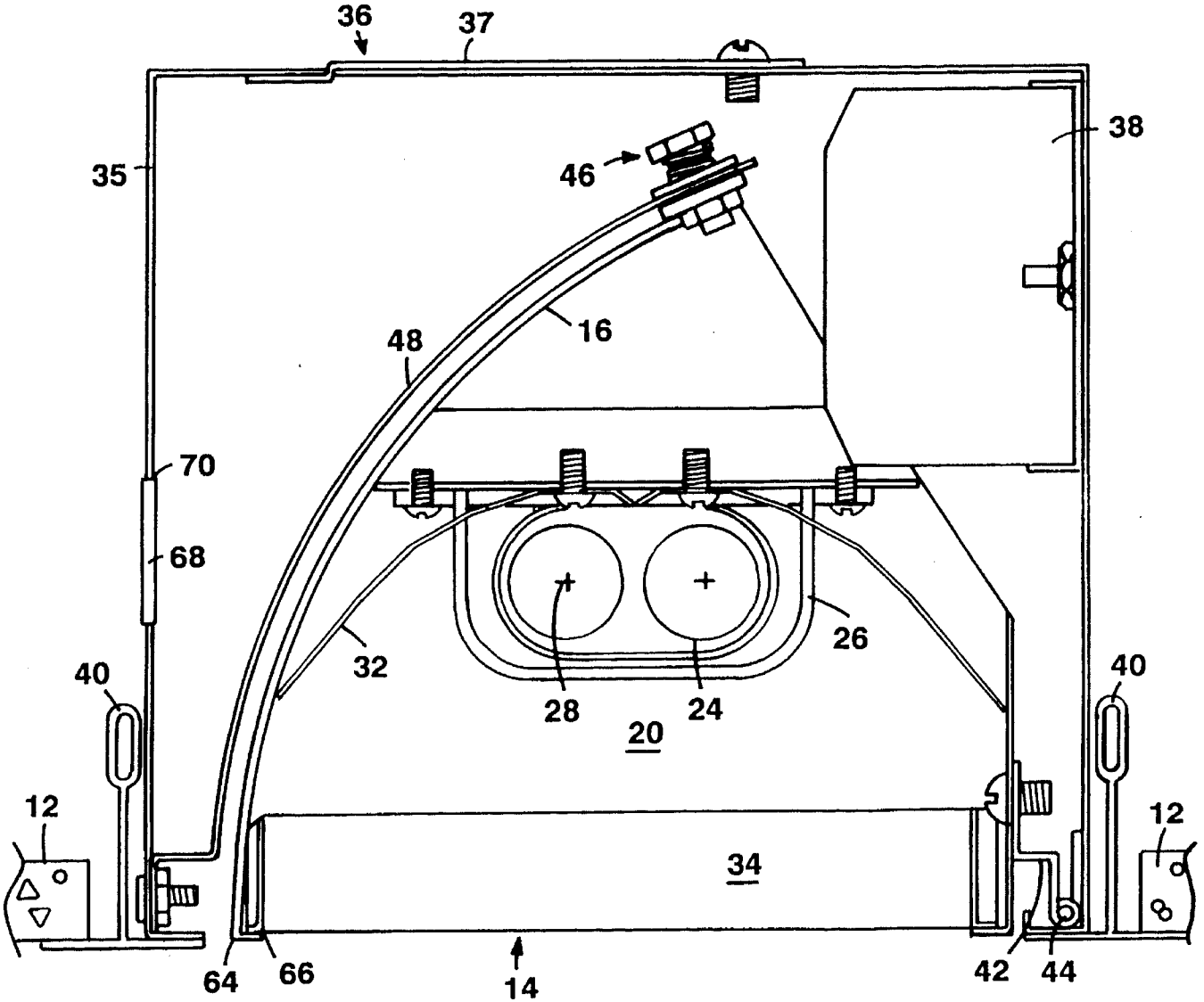
FIG. 4 is a cross-sectional view of the light fixture in the rotational orientation shown in FIG. 3.
Figure 5:
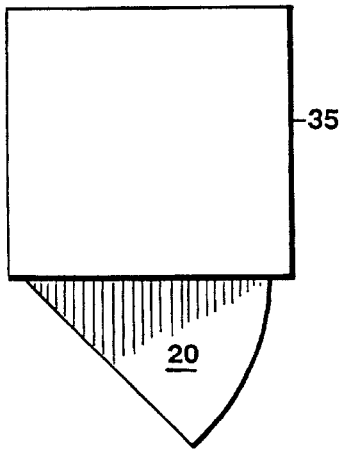
FIG. 5 is a schematic end view of the light fixture in the rotational orientation shown in FIG. 1.

As shown in FIGS. 1–4, an adjustable light fixture 10 installed in a suspended ceiling 12 includes a rotatable lamp assembly 14. As discussed below, lamp assembly 14 may be continuously rotated, with respect to ceiling 12, from the fully recessed orientation shown in FIGS. 3 and 4 to the fully rotated orientation shown in FIGS. 1 and 2. Lamp assembly 14, which is roughly a quarter-circle in cross-section, comprises a constant-radius curved wall 16 disposed opposite a flat wall 18. Walls 16, 18, which extend along the length of light fixture 10, are joined together at their respective ends by end sections 20 (FIG. 5). The edges of walls 16, 18 and end sections 20 together define a rectangular opening 22.

A lamp 24, such as a 40 watt biaxial fluorescent lamp, is installed in a lamp socket 26 in lamp assembly 14. Lamp socket 26 is oriented such that the longitudinal axis 28 of lamp 24 is aligned parallel to the longitudinal axis 30 of lamp assembly 14. Accordingly, lamp assembly 14 is sized to accommodate elongated lamps, i.e. lamps having a length greater than their width or diameter. For example, lamp assembly 14 is 6 in. (15.24 cm.) wide and 24 in. (60.96 cm.) long. A reflector 32 installed behind lamp 24 directs light from lamp 24 out of opening 22, and a series of baffles 34 disposed at regular intervals (e.g., every 2 in. (5.08 cm.)) in opening 22 reduces glare caused by lamp 24.

Figure 6:
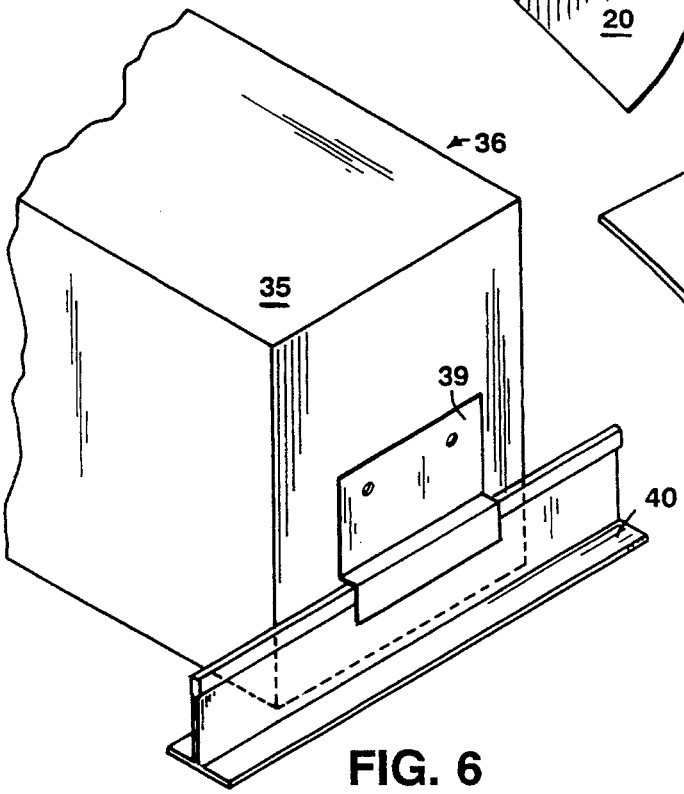
FIG. 6 is a schematic perspective view of an end of a housing of the light fixture.

A fixture housing 36, which at least partially encloses lamp assembly 14, comprises an elongated box 35, generally square in cross-section, that is closed at its ends and three of its sides. Fixture housing 36 is constructed of a rigid material. For example, housing 36 is die-formed of 20 GA steel. An access plate 37 at the top of housing 36 may be removed to wire lamp socket 26 to a ballast unit 38, and to wire ballast unit 38 to an external power supply (not shown). Because ballast unit 38 mounts to the inside wall of box 35, its weight does not affect the rotation of lamp assembly 14. As shown in FIG. 6, a z-shaped t-bar clip 39 welded to each end of housing 36 (only one end of housing 36 shown in FIG. 6) attaches to t-bars 40, which support suspended ceiling tiles 12 in a conventional manner.

A hinge 42, e.g., a continuous 18 GA piano hinge extending the length of fixture 10, is bolted to the corner of lamp assembly 14 disposed farthest from curved wall 16, and welded to housing 36. Hinge 42, which is located at or near the radial center of curved wall 16, allows lamp assembly 14 to be pivoted about an axis 44 with respect to housing 36. Thus, the axis of rotation 44 of lamp assembly 14 is generally aligned with (e.g., is parallel to) the longitudinal axis 28 of lamp 24.

Figure 7:
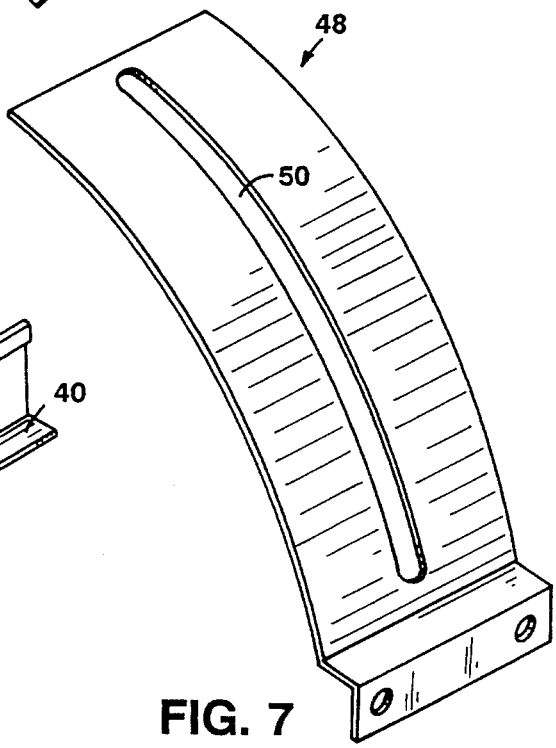
FIG. 7 is a perspective view of a curved guide plate of the light fixture.

The rotational orientation of lamp assembly 14 with respect to housing 36 is maintained by a friction assembly 46 acting in concert with a curved guide plate 48. Guide plate 48, which has a radius of curvature approximately equal to that of curved wall 16, bolts to the edge of housing 36 disposed opposite hinge 42. When it is installed, the radial center of guide plate 48 lies at or near the axis of rotation 44 of lamp assembly 14. As shown in FIG. 7, a slot 50 extends substantially the entire length of guide plate 48.

Figure 8:
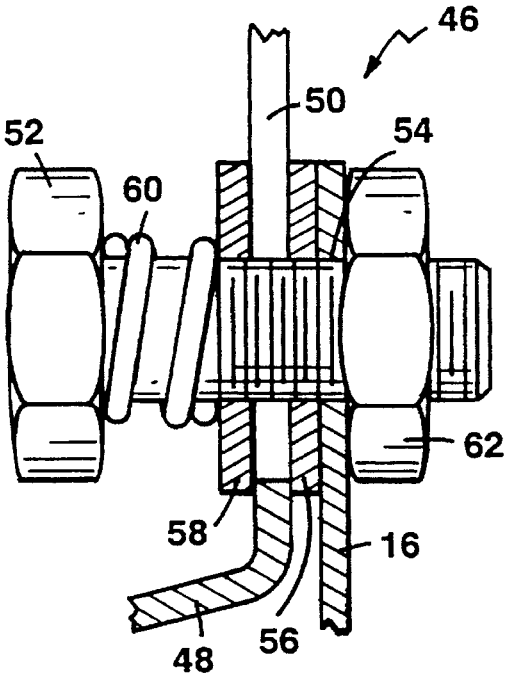
FIG. 8 is a cross-sectional view of a tension screw of the light fixture.

As shown in FIG. 8, friction assembly 46 includes a bolt 52 that extends through both slot 50 and a hole 54 in the top of curved wall 16. A first washer 56 is disposed between wall 16 and guide plate 48, and a second washer 58 is disposed between a compression spring 60 and guide plate 48. A nut 62 secures bolt 52 in place. Washers 56, 58, which are made of a relatively soft material, e.g., a plastic such as nylon, curved wall 16 from contacting guide plate 48. Because they are made of a softer material than any of these items, washers 56, 58 serve as bearings that reduce wear as wall 16 moves with respect to guide plate 48.

Figure 9:
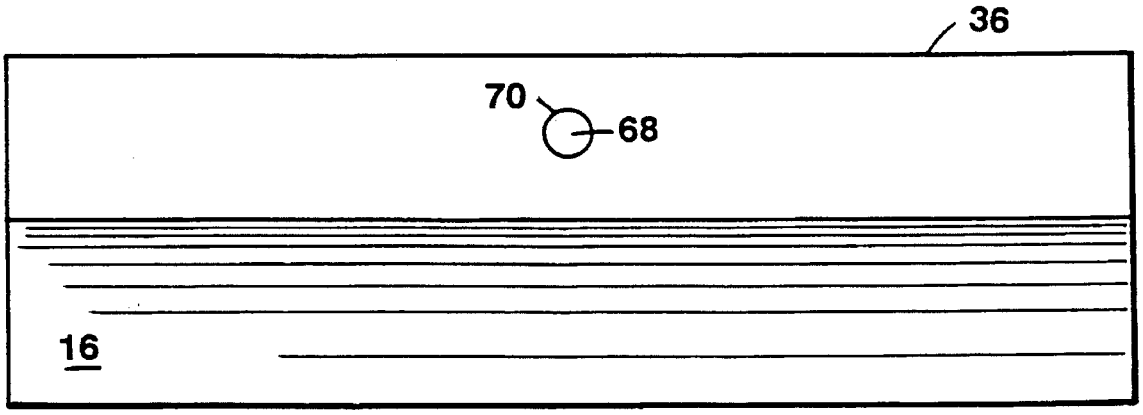
FIG. 9 is a schematic back view of the light fixture in the rotational orientation shown in FIG. 1.

In operation, to change the direction of illumination of light fixture 10, a user grasps the edge 64 of curved wall 16 (FIGS. 2 and 4), which is provided with a lip 66 for this purpose, and pushes or pulls lamp assembly 14 until the desired direction of illumination is achieved. Thus, for example, to illuminate the region directly below fixture 10, lamp assembly 14 is rotated upward until it is fully recessed, as depicted in FIGS. 3 and 4. If instead the user wishes to illuminate a vertical surface, e.g., a wall (not shown), near fixture 10, he or she would rotate lamp assembly 14 downward until the desired illumination effect is achieved. As shown in FIG. 9, curved wall 16 acts as a shield to direct the illumination in the desired direction.

Because friction assembly 46 travels in slot 50 of guide plate 48 as lamp assembly 14 is rotated, the arc length of slot 50 determines the range of rotation of lamp assembly 14. For example, this range may span from 0 to 60 degrees. The user can rotate lamp assembly 14 to any angle within this range of rotation. If friction assembly 46 is adjusted properly, the frictional force between washers 56, 58 and guide plate 48 maintains lamp assembly 14 in the desired rotational orientation.

If the frictional force between washers 56, 58 and guide plate 48 is too great, lamp assembly 14 may be difficult to rotate. Alternatively, if the frictional force is too low, lamp assembly 14 may rotate downward under the force of gravity alone. Should either be the case, an access plug 68, e.g., a round rubber plug inserted into a hole 70 in the back of housing 36 (FIGS. 2, 4, and 9), may be removed to provide access to friction assembly 44. Bolt 52 may then be loosened or tightened to vary the loading on spring 50, changing the frictional force between washers 56, 58 and guide plate 48.

Other embodiments are within the claims.

Figure 10:
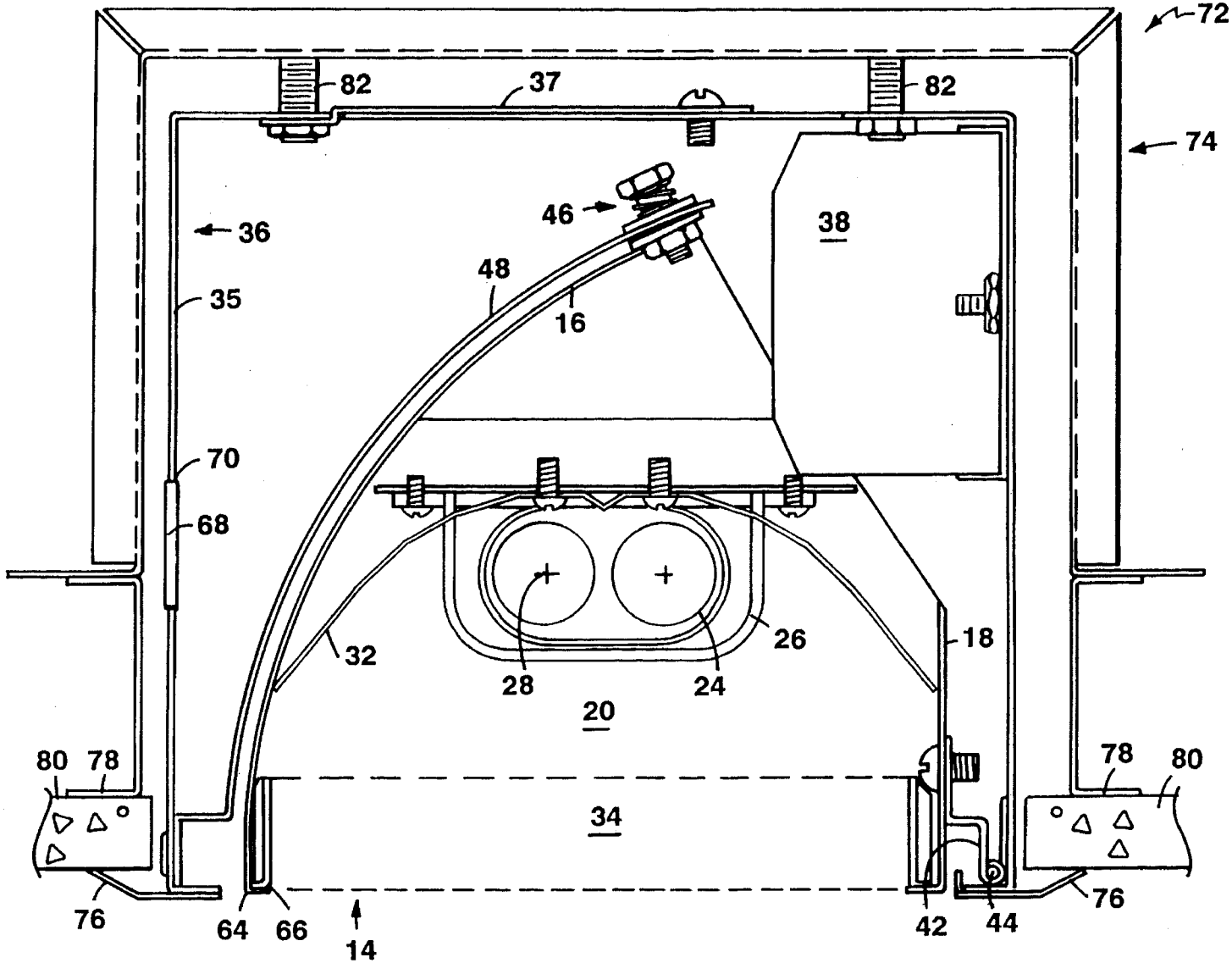
FIG. 10 is a cross-sectional view of another light fixture embodiment.

For example, a second adjustable light fixture 72 is shown in FIG. 10, with lamp assembly 14 fully rotated into housing 36. Light fixture 72 is identical to light fixture 10, except t-bar clips 39 have been replaced by an adjustable flange unit 74. Flange unit 74, which includes a pair of fixed lower support flanges 76 and a pair of adjustable upper flanges 78, allows light fixture 72 to be installed in a ceiling 80 of sufficient strength and integrity to support fixture 72 (e.g., a sheet rock ceiling). Lower support flanges 76 are placed against the exposed surface of ceiling 80, and adjustment screws 82 are turned until upper support flanges 78 are secure against the unexposed surface of ceiling 80.

Light fixtures 10, 72 need not be mounted in ceilings, but can be mounted in walls or other structures instead. Moreover, guide plate 48 need not be a curved bracket with a straight slot, as described above. For example, if the guide plate were located adjacent end sections 20 of lamp assembly 14, it could be a flat bracket with a curved slot.

What is claimed is:

1. A light fixture comprising a lamp assembly for supporting at least one elongated lamp, a mounting structure defining an opening sized to admit said lamp assembly, said lamp assembly being pivotally attached to said mounting structure so that said lamp assembly is rotatable about an axis substantially parallel to a longitudinal axis of said lamp, said lamp assembly being movable through said opening to a fully recessed position within said mounting structure, and a friction assembly attached to said lamp assembly, said friction assembly providing a slidable frictional interface with said mounting structure.

2. The light fixture of claim 1 wherein said mounting structure includes a bracket, and wherein said friction assembly provides a slidable frictional interface with said bracket.

3. The light fixture of claim 2 wherein said bracket is curved.

4. The light fixture of claim 2 wherein a portion of said friction assembly is disposed in a slot in said bracket.

5. The light fixture of claim 2 wherein said friction assembly includes first and second bearings disposed on opposite sides of said bracket.

6. A light fixture comprising:

a mounting structure having a bracket;

a lamp assembly for supporting at least one elongated lamp, said lamp assembly being pivotally attached to said mounting structure so that said lamp assembly is rotatable with respect to said mounting structure about an axis substantially parallel to a longitudinal axis of said lamp; and a friction assembly attached to said lamp assembly, said friction assembly having first and second bearings disposed on opposite sides of said bracket and a spring disposed to urge said first bearing toward said second bearing, said friction assembly providing a slidable frictional interface with said bracket.

7. The light fixture of claim 6 wherein said friction assembly is adjustable to vary a force exerted by said spring on said first bearing.

8. A light fixture comprising:

a mounting structure having a bracket;.

a lamp assembly for supporting at least one elongated lamp, said lamp assembly being pivotally attached to said mounting structure so that said lamp assembly is rotatable with respect to said mounting structure about an axis substantially parallel to a longitudinal axis of said lamp; and a friction assembly attached to said lamp assembly and having first and second bearings comprising nylon washers disposed on opposite sides of said bracket, said friction assembly providing a slidable frictional interface with said bracket.

9. The light fixture of claim 2 wherein said mounting structure includes mounts for attaching said light fixture to a ceiling.

10. The light fixture of claim 9 wherein said mounts are t-bar clips.

11. The light fixture of claim 9 wherein said mounts are adjustable flange units.

12. The light fixture of claim 9 wherein said mounts are constructed to allow said mounting structure to be installed into said ceiling so that said opening is substantially flush with a surface of said ceiling.

13. The light fixture of claim 2 wherein said elongated lamp is a florescent lamp.

14. The light fixture of claim 13 wherein a ballast for said florescent lamp is mounted to said mounting structure so as not to rotate with said lamp assembly.

15. The light fixture of claim 2 wherein said lamp assembly is pivotally attached to said mounting structure by a hinge extending substantially along the length of said lamp assembly.

16. The light fixture of claim 2 wherein said friction assembly includes a mechanism for adjusting the frictional force at said frictional interface.

17. The light fixture of claim 16 wherein said mounting structure includes an aperture providing access to adjust said mechanism.

18. The light fixture of claim 2 wherein said lamp assembly is rotatable through said opening to said fully recessed position within said mounting structure.

19. The light fixture of claim 2 wherein said axis of rotation of said lamp assembly is spaced apart from said longitudinal axis of said lamp.

20. The light fixture of claim 19 wherein said lamp assembly is pivotally attached to said mounting structure by a hinge.

21. The light fixture of claim 20 wherein said hinge is attached to said mounting structure adjacent said opening.

22. The light fixture of claim 2 wherein said mounting structure is substantially enclosed other than in the region of said opening.

23. A method of changing a direction of illumination, said method comprising the steps of:

providing a light fixture comprising:

a lamp assembly for supporting at least one elongated lamp;

a mounting structure having an opening sized to admit said lamp assembly, said lamp assembly being pivotally attached to said mounting structure so that said lamp assembly is rotatable about an axis substantially parallel to a longitudinal axis of said lamp; and a friction assembly attached to said lamp assembly, said friction assembly providing a slidable frictional interface with said mounting structure; and moving said lamp assembly through said opening to a fully recessed position within said mounting structure.

24. The method of claim 23 wherein said elongated lamp is a florescent lamp.

25. The method of claim 23 further comprising the step of installing said mounting structure into a ceiling so that said opening is substantially flush with a surface of said ceiling.

* * * * *

UNITED STATES PATENT AND TRADEMARK OFFICE

CERTIFICATE OF CORRECTION

PATENT NO. : 5,564,815

DATED : October 15, 1996

INVENTOR(S) : Eugene Littman et al.

It is certified that error appears in the above-identified patent and that said Letters Patent is hereby corrected as shown below:

TITLE PAGE:
In the References Cited section, U.S. Patent Documents, "4,799,178" should be --4,779,178--.

In the References Cited section, Other Publications, line 3, after "1992" start a new line.

In the References Cited section, Other Publications, line 7, after "714R" start a new line.

Col. 1, line 6, "florescent" should be --fluorescent--.

Col. 1, line 8, "florescent" should be --fluorescent--.

Col. 1, line 38, "florescent" should be --fluorescent--.

Col. 5, claim 9, line 1, "claim 2" should be --claim 1--.

Col. 5, claim 13, line 12, "claim 2" should be --claim 1--.

Col. 5, claim 13, line 13, "florescent" should be --fluorescent--.

Col. 5, claim 14, line 15, "florescent" should be --fluorescent--.

Col. 5, claim 15, line 17, "claim 2" should be --claim 1--.

Col. 5, claim 16, line 21, "claim 2" should be --claim 1--.

Col. 5, claim 18, line 27, "claim 2" should be --claim 1--.

Col. 5, claim 19, line 30, "claim 2" should be --claim 1--.

UNITED STATES PATENT AND TRADEMARK OFFICE

CERTIFICATE OF CORRECTION

PATENT NO. : 5,564,815

DATED : October 15, 1996

INVENTOR(S) : Eugene Littman et al.

It is certified that error appears in the above-identified patent and that said Letters Patent is hereby corrected as shown below:

Col. 6, claim 22, line 6, "claim 2" should be --claim 1--.

Col. 6, claim 24, line 26, "florescent" should be --fluorescent--.

Signed and Sealed this

Eighteenth Day of February, 1997

*Attest:*

*Attesting Officer*

BRUCE LEHMAN

*Commissioner of Patents and Trademarks*